United States Patent [19]

Brattstrom

[11] 4,142,844

[45] Mar. 6, 1979

[54] FAN BLADE ASSEMBLIES FOR BOX FANS

[75] Inventor: Edward H. Brattstrom, Pascoe Vale, Australia

[73] Assignee: Allware Agencies Ltd., London, England

[21] Appl. No.: 802,040

[22] Filed: May 31, 1977

[51] Int. Cl.[2] ..... F01D 5/00

[52] U.S. Cl. ..... 417/423 R; 415/119; 416/223 R; 416/243

[58] Field of Search ..... 415/119, 212 R, 213 R; 416/223, 243, DIG. 3; 417/423 R

[56] References Cited

U.S. PATENT DOCUMENTS

| | | | |
|---|---|---|---|
| 1,506,937 | 9/1924 | Miller | 416/223 |
| 1,775,863 | 4/1930 | Bishop | 416/243 |
| 1,991,095 | 2/1935 | Hochstetter | 416/223 |
| 2,011,821 | 8/1935 | Meyer et al. | 416/223 |
| 2,023,111 | 12/1935 | Alsing | 416/DIG. 3 |
| 2,097,389 | 10/1937 | Mey et al. | 416/243 |
| 2,212,041 | 8/1940 | Pfautsch | 416/243 |
| 2,240,597 | 5/1941 | Whitefield | 416/223 R |
| 2,460,902 | 2/1949 | Odor | 416/243 |
| 2,578,806 | 12/1951 | Johnson | 416/223 |

FOREIGN PATENT DOCUMENTS

| | | | |
|---|---|---|---|
| 459701 | 4/1971 | Australia | 417/234 |

*Primary Examiner*—C. J. Husar

*Attorney, Agent, or Firm*—Fitch, Even, Tabin & Luedeka

[57] ABSTRACT

A box fan comprising a box-like structure having front and rear openings interconnected to form a duct passing through said structure, said duct containing an electric motor and a large axial depth wide-bladed fan blade assembly operable by the motor to rotate about an axis of rotation, which fan blade assembly is so located that the center of gravity of said fan blade assembly is located near the rear opening, wherein the fan blade assembly has a plurality of blades each of which has a shape in a plane normal to the axis of rotation, which shape comprises a neck connecting the blade to a hub defining the center of the fan blade assembly, a slightly convex leading edge extending from said neck, a convex outermost edge, a slightly convex trailing edge and a chin portion connecting the trailing edge to the neck, said trailing edge being heavily set near said chin portion and being decreasingly heavily set as the outermost edge is approached along said trailing edge.

10 Claims, 7 Drawing Figures

FAN BLADE ASSEMBLIES FOR BOX FANS

The present invention relates to fans of a type known as box fans. In order to improve the safety of domestic fans a particular type of fan known as a box fan has been developed. Essentially such fans comprise a box-like structure having front and rear openings interconnected to form a duct passing through the structure which duct contains the motor and fan blade assembly. Normally the front and rear openings are enclosed by grilles. In the design of such fans it has been noted that the noise generated by the fan reaches a minimum as the fan blade assembly is moved along the axis of rotation into the duct while the air flow reaches a maximum as the fan blade assembly is moved along the axis of rotation away from the duct. However, the deviation of these maximum and minimum readings from those normally experienced for such fans operating in free space is usually less than 10%. In addition, usually the position of minimum noise level does not correspond with the position of maximum air flow.

It has now been discovered that for wide-bladed large axial depth fan blade assemblies having blades of a particular shape not only are the maxima and minima more accentuated, but they occur at substantially the same position on the axis of rotation relative to the opening of the duct containing the fan blade assemblies.

Accordingly there is provided a box fan comprising a box-like structure having front and rear openings interconnected to form a duct passing through said structure, said duct containing an electric motor and a large axial depth wide-bladed fan blade assembly operable by the motor to rotate about an axis of rotation, which fan blade assembly is so located that the centre of gravity of said fan blade assembly is located on the axis of rotation near the rear opening, wherein the fan blade assembly has a plurality of blades each of which has a shape in a plane normal to the axis of rotation which comprises a neck connecting the blade to a hub defining the centre of the assembly, a slightly convex leading edge extending from said neck, a convex outermost edge and a slightly convex trailing edge and a chin portion connecting the trailing edge to the neck, said trailing edge being heavily set near said chin portion and being decreasingly heavily set as the outermost edge is approached along said trailing edge.

The term "deep axial depth" when used to describe a fan blade normally means a blade having an angle of attack in excess of 20° while a blade is said to be heavily set if the increase in the angle of attack exceeds 25°.

The following terms used herein above have the following meanings:

- the "angle of attack" is the angle between the axis of rotation and the leading edge of each fan blade as viewed in sections transverse to the blade;
- the "set" of a blade is the increase in the angle of attack on a line from the leading edge to the trailing edge;
- the "radius" of the fan blade assembly is the distance from the axis of rotation to the furthermost point on the peripheral edge.

The "shape" of the blades can be largely defined by the mean radii of curvature which determine the shape of the leading, outermost and trailing edges.

Preferably the mean radii of curvature of the leading and trailing edges lie in the range between 70% of the radius of the fan blade assembly, and infinity. That is between a shape defined by a slightly convex edge and an edge which is linear.

As a substantial portion of the noise generated by a rotating fan blade assembly is generated at the periphery of the blades, it is normal for that portion of each blade which connects the leading edge to the outermost edge to be swept back. In addition the mean radius of curvature of the outermost edge preferably lies in the range between 40% and 60% of the radius of the fan blade assembly. Another source of noise in wide-bladed large axial depth fans, (i.e., wide-bladed fans with a high pitch) occurs when a blade intersects the vortex created by the trailing edge of the preceding blade. In order to avoid this problem the fan blade assemblies of the present invention have been constructed with a heavily set trailing edge. The set tapers from a maximum at the chin to a minimum at the junction with the outermost edge. The set ensures that air intersected by the leading edge near the axis of rotation is given sufficient axial acceleration by the trailing edge to avoid interference with the following blade. In the present invention the angle of attack is in excess of 20° and the maximum set is in excess of 25°. Preferably the angle of attack lies in the range between 20° to 30° and the maximum set lies in the range between 30° to 45°.

Preferably the duct is circular in cross-section and the rear opening of said duct has a radius which lies in the range between 1.05R and 1.20R where R is the radius of the fan blade assembly.

The benefits of the present invention may be obtained by locating the blade assembly such that its centre of gravity is situated at a point which lies in the range between a point 10 mm in from a plane defining the rear opening of the duct and a point 2.5 mm outside said rear opening.

Preferably also the plane defining the rear opening is normal to the axis of rotation of said fan blade assembly and the duct has an axis of symmetry which is contiguous with said axis of rotation.

The invention will now be further described with reference to a preferred embodiment illustrated in the accompanying drawings, wherein FIG. 1 shows a partial rear view of a fan blade assembly, viewed in the plane normal to the axis of rotation.

Figure 7:
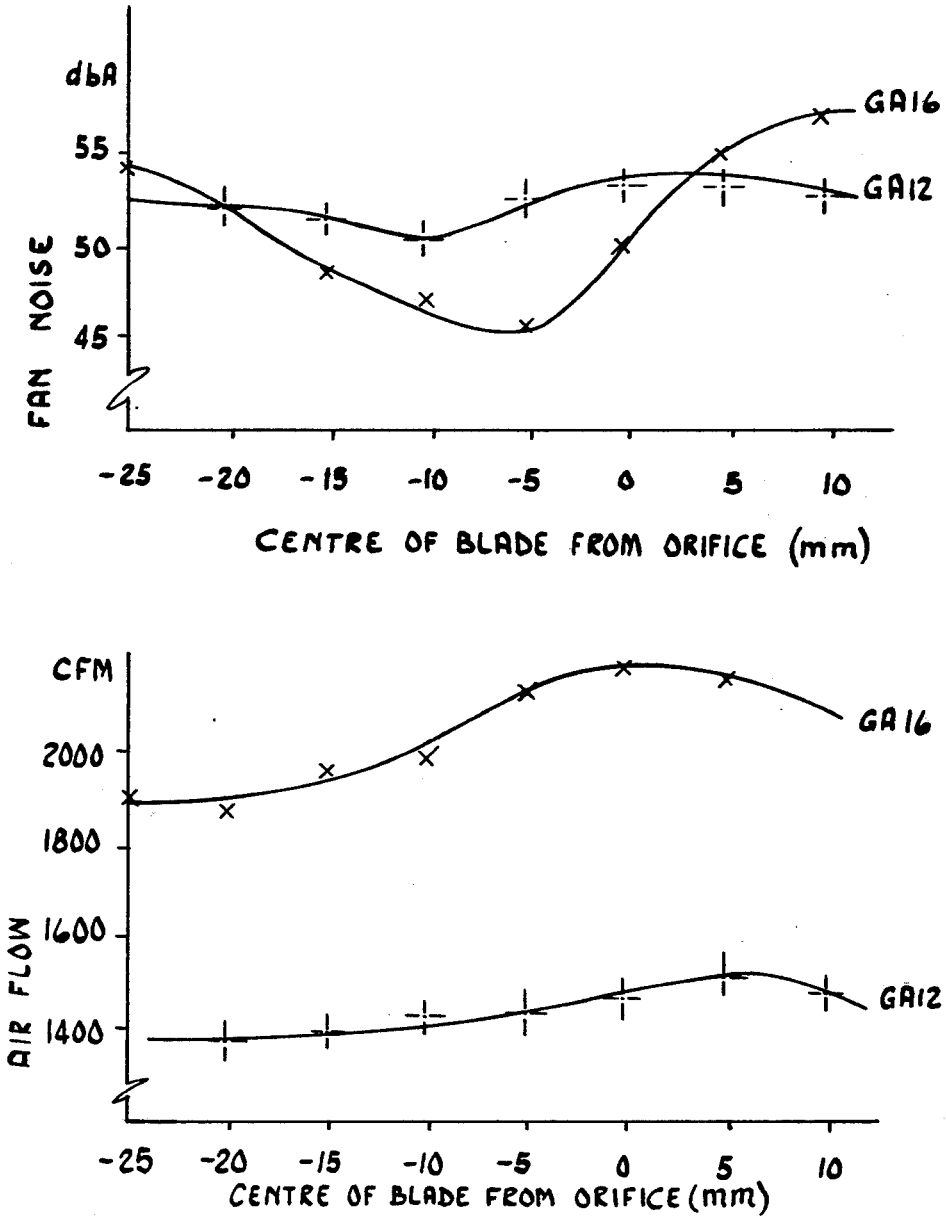

FIG. 7 comprises two → graphs illustrating the effect of varying blade shape and axial position on noise production and flow rate.

Figure 1:
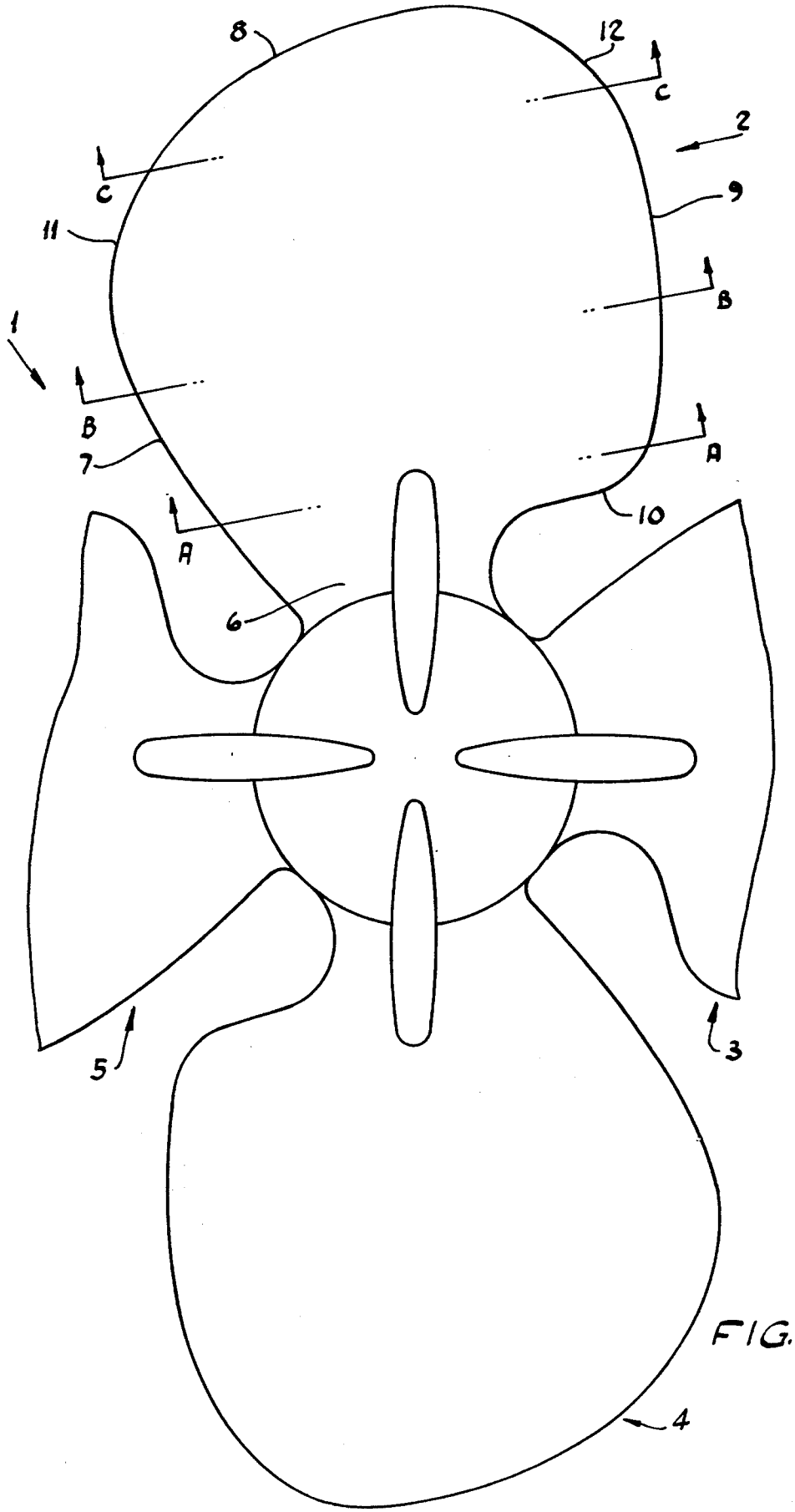
Figure 2:
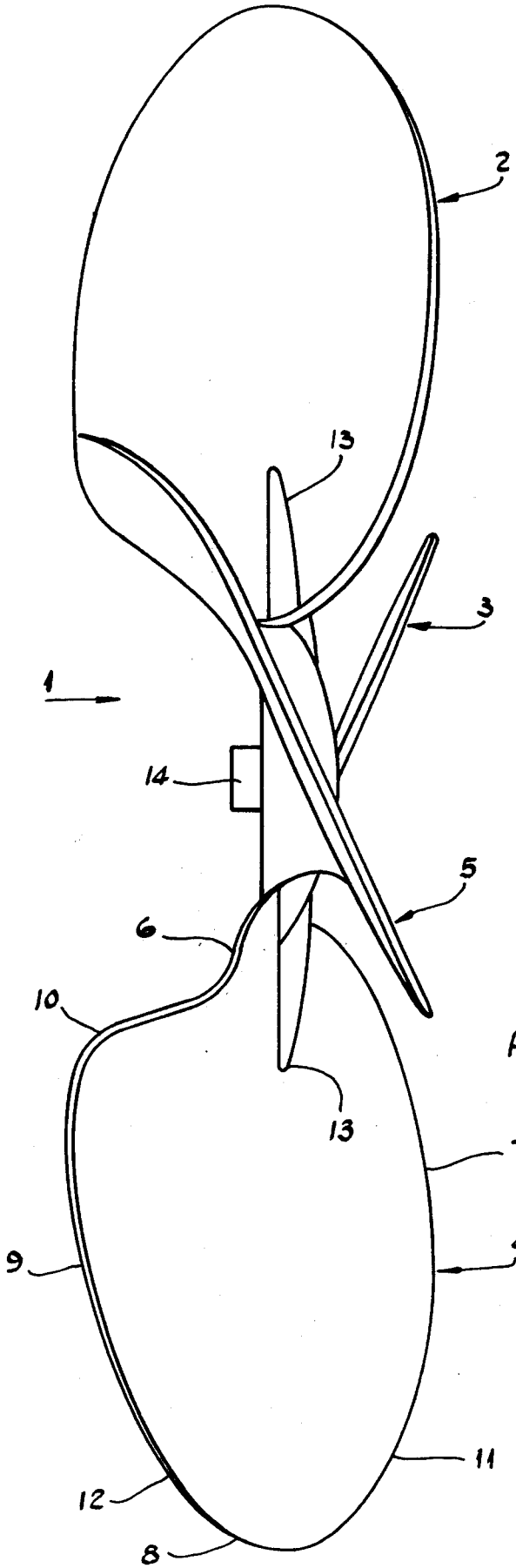
FIG. 2 shows a side elevation of a fan blade assembly according to the invention.

FIGS. 1 and 2 show a fan blade assembly 1 comprising a central hub 14 from which extend four identical blades 2, 3, 4 and 5 (parts of blades 3 and 5 not being shown). Each blade has a neck portion 6 adjacent hub 14, a leading edge 7, an outermost edge 8, trailing edge 9 and chin portion 10 which connects the trailing edge 9 to the neck. The leading edge 7 and the trailing edge 9 are both slightly convex in shape, the radii of curvature defining each edge approaching in magnitude the radius of the assembly. The outermost edge 8 is also convex but has a radius of curvature which is substantially smaller than those defining the leading and trailing edges. The outermost edge 8 is connected to the leading and trailing edges by connecting edges 11 and 12. Connecting edge 11 connects the leading edge with the outermost edge, while connecting edge 12 connects the outermost edge with the trailing edge. The radii defining the connecting edges 11 and 12 are approximately half the magnitude of those defining the outermost edge. The chin portion is also convex and has a mean radius of curvature of approximately 1" while the neck portion has a concave rear edge. In order to strengthen the structure the assembly has ribs 13. The angle of attack and set of blade 5 can be clearly seen in FIG. 2.

Figure 3:
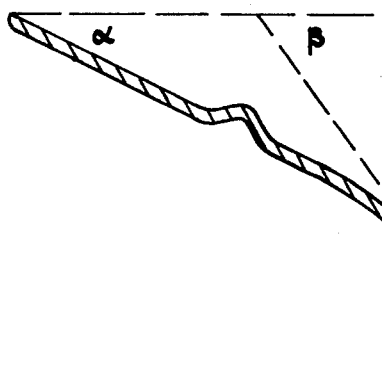
FIGS. 3, 4 and 5 are cross sectional views, along respective lines A—A, B—B and C—C in FIG. 1, of a blade of the fan blade assembly shown in FIG. 1.
Figure 4:
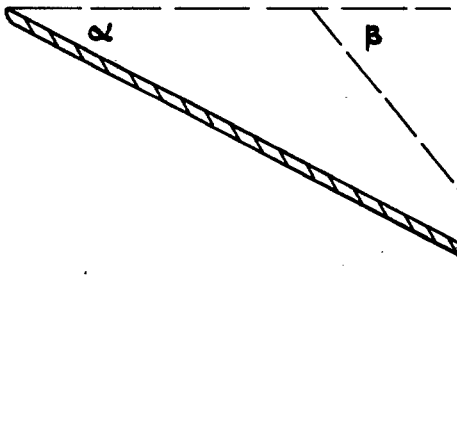
Figure 5:
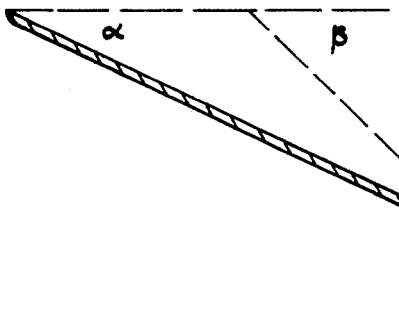

FIGS. 3, 4 and 5 illustrate the angle of attack $\alpha$ and the set $\beta$ of the blade at various positions proceding outwards from the neck of the blade. As sown in FIG. 3, the set $\beta$ approaches an angle of 45° at a distance of approximately one-third of the blade radius from the hub, while FIG. 4 shows that the set $\beta$ becomes lighter as the peripheral edge is approached. The maximum set at this position approaches 35°. In addition the angle of attack is only increased over a distance of approximately one-sixth of the blade width. Similarly, FIG. 5 shows that the set at the top end of the trailing edge is lighter and only increases the angle of attack over approximately one-eight of the blade width at this point.

Figure 6:
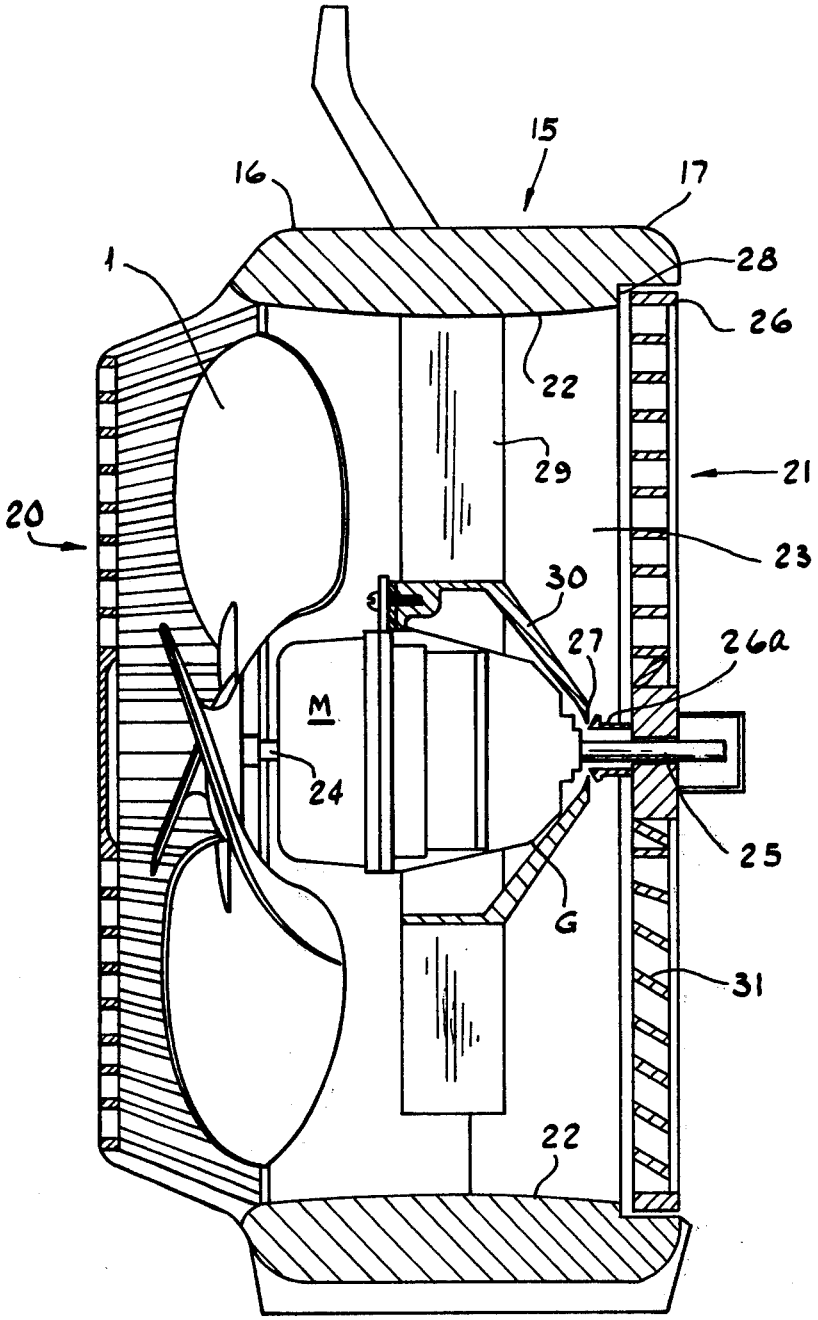
FIG. 6 is an axial cross-section of a box fan containing a fan blade assembly according to the invention.

FIG. 6 illustrates a box fan 15 containing a fan blade assembly 1 according to the invention. The box fan 15 comprises a rear section 16 and a front section 17 held together by clips (not shown). Both sections have openings 20 and 21 respectively which are interconnected by a wall 22 to form a duct 23. The duct is circular in cross section but the wall 22 tapers slightly from each opening towards the centre thereof. The duct contains a motor M to the output shaft of which the fan blade assembly 1 is attached. The motor is operable to rotate the fan blade assembly via shaft 24. The axis of rotation of the fan blade assembly coincides with the axis of symmetry of said duct. The fan blade assembly is located at a point on the axis of rotation such that the centre of gravity of the assembly is located 2.5 mm in from the rear opening. The rear opening is enclosed by a resilient dished grille which is resiliently located and held in position by lugs (not shown) slotted into wall 22. The motor is provided with gears G which are connected to an output shaft 25 which drives a rotatable grille 26 at a fraction of the speed of the fan blade assembly by means of a slipping clutch mechanism (not shown). Alternatively, the grille may be constructed so that it is rotated by air flow through the duct, being governed in its speed of rotation by a slipping clutch governor. The rotatable grille is slidably mounted on output shaft 25 and is provided with locking fingers **26*a* which may be engaged by locking ring 27. Engagement of the tongue with the locking ring is effected by pushing the grille inward so that the periphery thereof engages an annular part 28. The front opening and the centre of the grille is bowed slightly inwards against the natural resilience thereof so that the rim of the grille is then resiliently biased against the annular part 28**. The frictional engagement between the rim of the grille and the adjacent annular part is sufficient to lock the rotating grille in place.

The duct also contains vanes 29 which are held within the duct and support cage 30 which contains the motor and gears and on which the locking ring 27 is supported. The rotating grille 26 has air directing louvres 31 arranged at differing angles to the direction of air flow. In normal operation of the fan, air is drawn in through the rear grille, passes through the vanes 29 which partially straighten the air flow, and is then deflected by the louvres to various parts of a room in which the fan is placed. The slipping clutch permits the grille 26 to rotate at such a speed that air is effectively distributed in a manner typical of a gyratory fan.

FIG. 7 illustrates the effect on noise and air flow of shifting two fan blade assemblies having different blade types along the axis of rotation. The two blade assemblies are characterized as follows:

| | GA12 | GA16 |
|---|---|---|
| Blade diameter | 12" | 12" |
| Shape of leading edge | Convex | Slightly Convex |
| Shape of trailing edge | Concave | Slightly Convex |
| Shape of outermost edge | Convex | Convex |
| Shape of chin | No chin | Convex |
| Radii of Curvature: | | |
| leading edge | 2.187 - 3.000 | 5.300" |
| trailing edge | 2.970 | 4.147" |
| outermost edge | 2.344 - 3.250 | 2.997" |
| chin | — | 0.625" |

The area of the GA16 blades was slightly less than that of the GA12 blades. The GA16 blades were further characterized by being heavily set near the chin as illustrated in FIGS. 3, 4 and 5. The set tapered off towards the outermost edge. The GA12 blades were only slightly set (i.e., approaching 15°). The diameter of the duct in each case was 13".

The noise generated by each assembly was determined by placing a noise recording device type No. 1408C manufactured by Dawe Instruments Limited, at a point 36 inches behind the fan blade in line with the axis of rotation of the assemblies. The noise attributable to the fan blade assembly was then determined by making an allowance for background noise in accordance with a correction table supplied by the manufacturers.

These graphs clearly show the pronounced minimum noise level which occurs when the centre of gravity of the GA16 assembly is located 5 mm inside the duct and the pronounced maximum air flow which occurs when the centre of gravity of the GA16 assembly is located in line with the opening of the duct. The graphs also show that not only are the maximum and minimum air flow and noise level for the GA12 assembly less pronounced, but they are separated by a distance of 15 mm.

I claim:

1. A box fan comprising a box-like structure having a front and rear opening interconnected to form a duct passing through said structure said duct containing an electric motor and a large axial depth wide-bladed fan blade assembly operable by the motor to rotate about an axis of rotation, which fan blade assembly is so located that the centre of gravity of said fan blade assembly is located near the rear opening, wherein the fan blade assembly has a plurality of blades each of which has a shape in a plane normal to the axis of rotation, which shape comprises a neck connecting the blade to a hub defining the centre of the assembly, a slightly convex leading edge extending from said neck, a convex outermost edge, a slightly convex trailing edge and a chin portion connecting the trailing edge to the neck, said trailing edge being heavily set near said chin portion and being decreasingly heavily set as the outermost edge is approached along said trailing edge.

2. A box fan according to claim 1, wherein each blade has an angle of attack in the range between 20° and 30°.

3. A box fan according to claim 1, wherein the trailing edge of each blade has a maximum set lying in the range between 30° and 45°.

4. A box fan according to claim 1, wherein said shape of each blade is further defined by convex connecting edges connecting said leading and trailing edges with said outermost edge.

5. A box fan according to claim 1, wherein the leading and trailing edges are defined by radii of curvature which approximate the radius of the fan blade assembly and the outermost edge is defined by a radius of curvature which is approximately half the radius of said fan blade assembly.

6. A box fan according to claim 4, wherein the connecting edges are defined by radii of curvature which lie in the range of one-fifth to one-third of the radius of said fan blade assembly.

7. A box fan according to claim 1, wherein the axis of rotation is contiguous with the axis of symmetry of said duct.

8. A box fan according to claim 7, wherein the rear opening of said duct defines a circle having a radius which lies in the range from 1.05R to 1.20R, said circle being in a plane normal to the axis of symmetry of the duct, the fan blade assembly is so located that its centre of gravity is situated on said axis at a point which lies in the range between a point inside said duct 10 mm. from said plane and a point outside said duct 2.5 mm. from said plane and the leading, trailing and outermost edges of said blades have mean radii of curvature which lie in the range from 0.7R to infinity, 0.7R to infinity and 0.4R to 0.6R respectively, where R is the radius of the fan blade assembly.

9. A box fan according to claim 7, wherein the rear opening of said duct defines a circle having a radius which lies in the range from 1.05R to 1.20R, said circle being in a plane normal to the axis of symmetry of the duct, the centre of gravity of the fan blade assembly is located on said axis at a point inside said duct 2.5 mm from said plane and the leading, trailing and outermost edges of said blades have mean radii of curvature which lie in the range from 0.7R to infinity, 0.7R to infinity and 0.4R to 0.6R respectively, where R is the radius of the fan blade assembly.

10. A box fan comprising a box-like structure having a front and rear opening interconnected to form a duct passing through said structure, said duct containing an electric motor and a large axial depth wide-bladed fan blade assembly operable by the motor to rotate about an axis of rotation wherein, the rear opening, the duct and the blades comprising the fan blade assembly include means for causing the air flow to approach a maximum and noise generation to approach a minimum including means for positioning the fan blade assembly with respect to the duct so that the centre of gravity of the fan blade is situated between a point 10 mm in from a plane defining the rear opening of the duct and a point 2.5 mm outside said plane.

* * * * *